United States Patent [19]

Kress

[11] Patent Number: 4,790,677

[45] Date of Patent: Dec. 13, 1988

[54] METHOD AND APPARATUS FOR DETERMINING HALT OF TAPE FEED IN A TAPE CARTRIDGE FOR A PRINTER

[75] Inventor: Kenneth Kress, Huntington, N.Y.

[73] Assignee: Primages, Inc., Bohemia, N.Y.

[21] Appl. No.: 783,768

[22] Filed: Oct. 3, 1985

[51] Int. Cl.[4] ..... B41J 35/36

[52] U.S. Cl. ..... 400/249; 400/208; 400/234; 242/198

[58] Field of Search ..... 400/208, 234, 249; 242/198

[56] References Cited

U.S. PATENT DOCUMENTS

| | | | |
|---|---|---|---|
| 3,442,366 | 5/1969 | Spears | 400/234 |
| 4,010,839 | 3/1977 | Guerrini et al. | 400/234 X |
| 4,091,913 | 5/1978 | Ku et al. | 400/249 X |
| 4,111,378 | 9/1978 | Barwick | 400/249 X |
| 4,115,013 | 9/1978 | Hedstrom | 400/249 |
| 4,225,100 | 9/1980 | Sugawara | 242/198 |
| 4,337,001 | 6/1982 | Cappotto | 400/208 |
| 4,368,992 | 1/1983 | Gagnebin | 400/234 X |
| 4,373,824 | 2/1983 | Olsen | 400/234 |

FOREIGN PATENT DOCUMENTS

| | | | |
|---|---|---|---|
| 0121971 | 10/1984 | European Pat. Off. | 400/249 |
| 2632146 | 2/1977 | Fed. Rep. of Germany | 400/208 |
| 2746059 | 4/1979 | Fed. Rep. of Germany | 400/249 |
| 0214338 | 10/1984 | German Democratic Rep. | 400/249 |

OTHER PUBLICATIONS

IBM Technical Disclosure Bulletin, "Constant-Tension Ribbon Cartridge", Bullock et al., vol. 23, No. 5, Oct. 1980, pp. 1741-1742.

IBM Technical Disclosure Bulletin, "Microcontrolled Ribbon Motion and Splice Detection System", Cavill et al., vol. 24, No. 10, Mar. 1982, pp. 5015-5016.

*Primary Examiner*—Ernest T. Wright, Jr.

[57] ABSTRACT

Apparatus and method for use with a tape cartridge of a printer to determine halt of tape feed from a supply reel to a take-up reel of the cartridge comprising reflective and non-reflective portions on the supply reel rotating therewith and an assembly including a light source and a sensor fixed in position to face the supply reel to cooperate with the reflective and non-reflective portions without mechanical contact therewith for producing a train of successive electrical output pulses as the supply reel rotates. Upon cessation of the output pulses the tape feed is halted. The system also provides a mechanical locking device for effecting positive locking of the supply reel at the end of tape feed.

4 Claims, 2 Drawing Sheets

METHOD AND APPARATUS FOR DETERMINING HALT OF TAPE FEED IN A TAPE CARTRIDGE FOR A PRINTER

FIELD OF THE INVENTION

The invention relates to methods and apparatus for use with a tape cartridge associated with a printer to determine halt of tape feed from a supply reel to a take-up reel of the printer. More particularly, the invention relates to methods and apparatus for detecting tape breakage or end of tape feed.

BACKGROUND

In conventional tape cartridges for printers and typewriters and the like, the end of tape feed can be sensed by detecting the passage of a reflective element at the end of the tape past a sensor. At such time a reflective pulse is produced from a light source and the sensor acts to produce an electrical signal which halts the drive of the tape and carrier.

As disclosed in U.S. Pat. No. 4,115,013, a sensor can be fixed on the body of a carrier and the cartridge can be provided with an opening into which the sensor fits when the cartridge is mounted on the carrier. The position of the sensor is such that the light source projects a beam on the tape and at the end of tape feed, and a reflective element comes into a position where it reflects the light back to the sensor to generate a signal which halts the tape feed and printer.

This conventional system is effective and reliable and has found widespread usage. However, it has the deficiency that if the tape breaks, the tape drive continues and the printer operates without producing any printing due to the absence of a tape supply.

According to another known system, a mechanical flag is oscillated as the tape supply reel rotates and the flag is positioned between a light source and a sensor. Hence, as the supply reel continues to rotate, an intermittent pulse is produced by the sensor to indicate such continuous rotation. In the absence of a continuous train of pulses, the drive is halted.

This system has the advantage that if there is a break in the tape, the drives of the carrier and tape will be halted. However, the system has the disadvantage of using mechanical connections which are detrimental to the smooth rotation of the supply reel and can lead to breakdowns.

In another system, the opaque tape passes between a light source and a receiver to block passage of light therebetween and, at the end of the tape, a transparent portion is provided so that light can pass from the source to the receiver. Hence, at the end of the tape, a signal is produced to halt the tape feed and carrier drive. Should the tape break downstream of the light source and receiver, the carrier drive will continue to operate as will the tape feed despite the fact that no tape is being fed. If the tape breaks upstream of the light source and receiver, the loose length of tape will continue to be pulled by the tape feed until it passes through the light source and receiver whereupon the tape feed and carrier drive will be halted. This system lacks certainty in detecting tape breakage and unless breakage takes place precisely at the light source and receiver (a highly unlikely occurrence), either there will be no detection (downstream breakage) or there will be a lengthy delay in the detection (upstream breakage).

SUMMARY OF THE INVENTION

An object of the invention is to provide a method and apparatus by which continuous rotation of the supply reel can be detected without mechanical contact with the supply reel.

A further object of the invention is to utilize the sensed rotation of the supply reel to determine continuous feed of tape and, in the event of interruption of tape feed, to halt the printing operation.

In accordance with the above and further objects of the invention, there is provided apparatus for use with a tape cartridge for a printer to determine halt of tape feed from a supply reel to a take-up reel of the printer, said apparatus comprising first means on one of the reels for undergoing rotation therewith and second means fixed in position to face said first means to cooperate with said first means without mechanical contact therewith for producing electrical output pulses as said first means rotates with said one reel. A third means is coupled to the second means for determining halting of rotation of said one reel and consequent halting of tape feed upon cessation of said output pulses.

In accordance with a feature of the invention, the first means comprises alternate reflective and non-reflective portions and the second means is a sensor which produces a train of electrical output pulses in accordance with the periodic reflection to the sensor from the reflective portion as it passes the sensor.

In a preferred embodiment, the reflective and nonreflective portions are in the form of radial stripes directly applied to the bottom of the supply reel. This produces a train of pulses in the sensor which establishes that the supply reel is rotating and, hence, the tape is being fed. Upon tape breakage or when the tape stops its feed at the end of the tape, the train of pulses ceases and the drive is halted.

In order to avoid instability at the end of feed of tape from the supply reel, a further object of the invention is to positively lock the supply reel at the end of tape feed. This can be achieved advantageously by sensing increased tape tension at the end of feed of the tape.

The invention will be described in detail below with reference to specific embodiments thereof as illustrated in the attached drawing.

DETAILED DESCRIPTION OF THE PREFERRED EMBODIMENT

Figure 2:
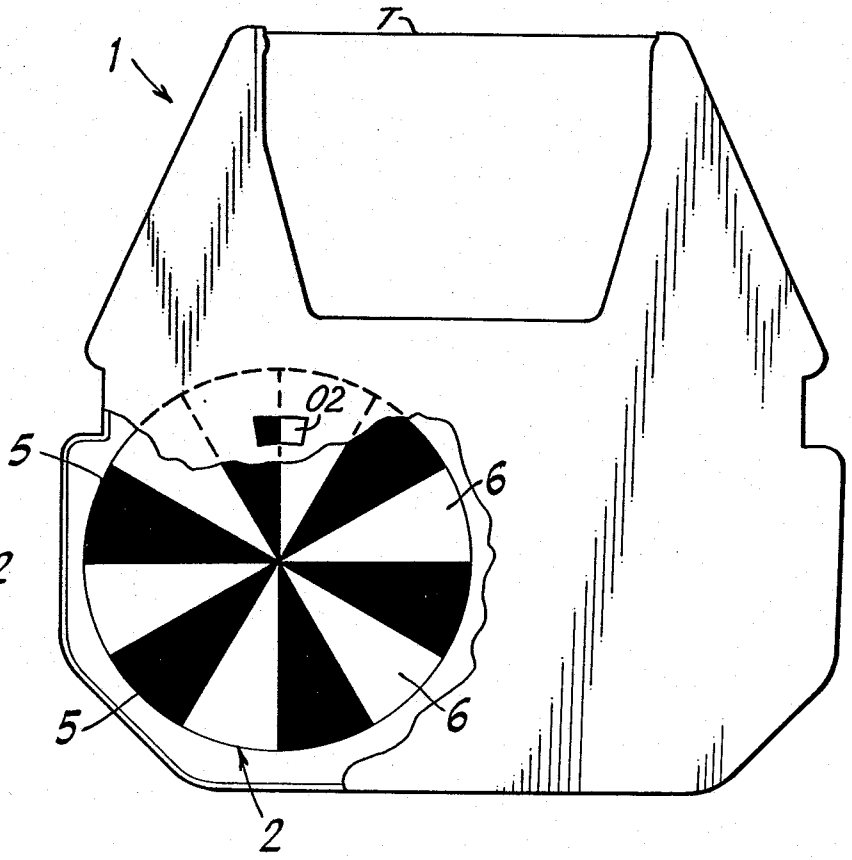
FIG. 2 is a bottom plan view, partly broken away, of the tape cartridge.

In the drawing there is seen a tape cartridge 1 generally made of molded plastic which contains a supply reel 2 and a take-up reel 3. The cartridge 1 is mounted on a carrier 4 of a printer which transports the cartridge 1 during the printing operation. The tape T is unwound from the supply reel 2 by driving a capstan C and the take-up reel 3 as the carrier 4 is transported during the printing operation. The drive of the carrier 4 and of capstan C and the take-up reel 3 is well-known in the art and requires no further explanation hereat since it does not form any part of the present invention.

Conventionally, in one known arrangement, when all of the tape has been unwound from the supply reel, a reflective element at the end of the tape travels past a sensor which receives reflected light from the reflective element and produces a signal to halt the drive of the carrier. A fresh cartridge is then placed on the carrier and printing is resumed.

Since the halting of the drive occurs only at the end of the tape when the sensor receives a reflected pulse from the reflective element, the system is unable to detect tape breakage and, in such case, the printing operation proceeds as if tape is being fed from the supply reel to the take-up reel. Accordingly, the machine keeps printing but no copy is made since tape feed is interrupted.

In another known embodiment, a transparent portion is provided at the end of the tape and the otherwise opaque tape passes between a light source and a receiver to block light passage therebetween. At the end of the tape, the transparent portion permits light to pass to the sensor to halt the drive of carrier. If the tape breaks downstream of the light source and receiver, the carrier drive and the drive of capstan will continue to operate despite the fact that no tape is being fed. If the tape breaks upstream of the light source and receiver, the loose length of tape will continue to be pulled by the tape feed until it passes through the light source and receiver whereupon the capstan C and carrier drive will be halted. This system lacks certainty in detecting tape breakage and unless breakage takes place precisely at the light source and receiver (a highly unlikely occurrence) either there will be no detection (downstream breakage) or there will be a lengthy delay in the detection (upstream breakage).

The invention provides for a system by which both end of tape and tape breakage are detected rapidly without any mechanical contact with the reels 2 and 3. In particular, as seen in FIG. 2, the bottom of the supply reel 2 is provided with a succession of alternate reflective and non-reflective portions 5 and 6 respectively. Mounted within a cavity 7 in the carrier 4 is an assembly 8 which comprises a light emitting diode 9 and a light sensor 10. Preferably, the light emitting diode 9 is a gallium arsenide infrared emitting diode and the sensor 10 is an N-P-N silicon photo-transistor. This is a conventional assembly and the diode 9 and photo-transistor 10 are typically mounted in a molded plastic housing.

The assembly 8 is fixed in the carrier 4 and faces the bottom of the supply reel 2 through openings 01 and 02 such that when the supply reel 2 rotates during feed of the tape T, the sensor 10 produces a train of electrical pulses due to the successive passage of the reflective and non-reflective portions 5,6 past the sensor 10. The pulses are fed to one input of a comparator 11 serving as a wave shaper, and a reference voltage is fed to its other input. The output of the comparator 11 is connected to a microprocessor 12 which controls the operation of carrier drive 13 and tape drive 14. When the train of pulses is interrupted due to stoppage of the rotation of the supply reel 2, the microprocessor 12 halts the carrier drive 13 and the tape drive 14.

From the above, it is seen that the train of spaced output pulses from the light sensor 10 are indicative of the continuous rotation of the supply reel 2 which, in turn, indicates a continuous feed of the tape T to the take-up reel 3.

In order to produce the train of pulses, the reflective and non-reflective portions 5 and 6 are in the form of radial stripes or bands which can be directly applied to the bottom of the supply reel 2 or applied to an element which is secured to the supply reel 2 for rotation therewith.

Although the invention has been described in relation to an embodiment which employs light reflection in order to generate the train of electrical pulses, other embodiments are equally applicable in which pulses are produced by periodic change of state of energy which is other than light. For example, magnetic pulses can be produced by a Hall effect sensor or reed switches utilizing magnetic elements.

Figure 3:
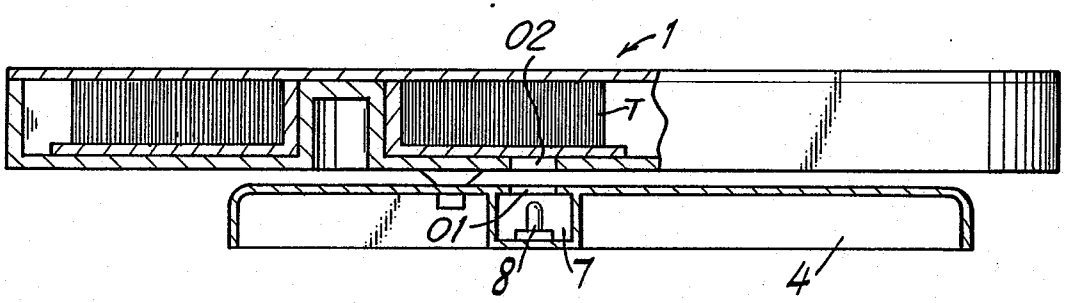
FIG. 3 is a front elevational view, partly broken away, of a portion of the cartridge installed on a carrier of the printer.
Figure 4:
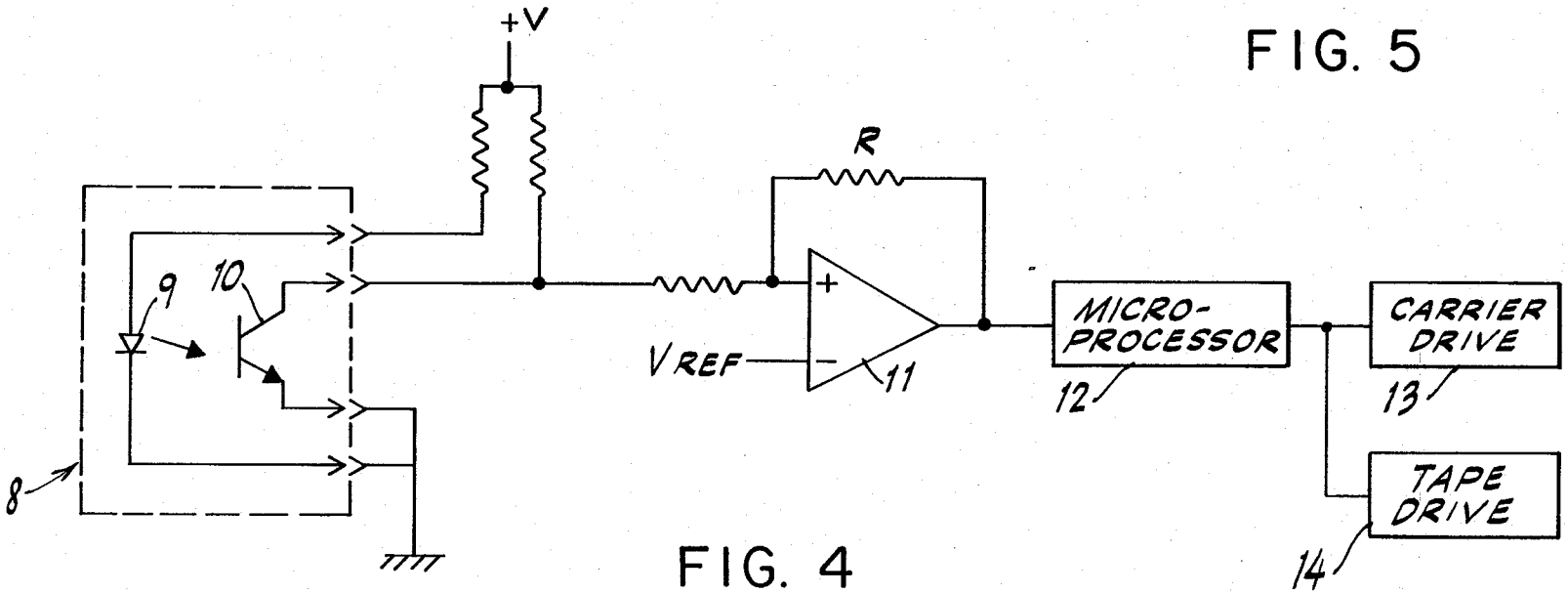
FIG. 4 is a schematic circuit diagram illustrating the operation of the apparatus of the invention.

When using the assembly illustrated in FIGS. 3 and 4, if, when the end of tape T is reached, the supply reel 2 should happen to be stopped at a position in which the sensor 10 is precisely at the transition between a reflective and non-reflective portion 5 and 6, shaking of the carrier 4 could produce an erroneous train of electrical pulses which could maintain the drive of the carrier 4 without feed of the tape T. In order to obviate this possibility, the comparator 11 is provided with high hysteresis by incorporation of a low value resistor R in a feedback circuit. This will insure halt of the carrier drive 13 only when the reflective and non-reflective portions 5 and 6 cease to travel past the sensor 10 in succession.

A further condition of instability can take place at the end of tape feed when the normally adhesively secured end of the tape T can peel off the supply reel 2. As the tape T peels off the supply reel 2, the supply reel 2 rotates and thus pulses are produced from the radial stripes 5 and 6 which give the semblance of normal operation instead of an end of tape condition.

In further accordance with the invention, there is provided a means for positively locking the supply reel 2 at the end of tape feed therefrom. The locking takes place in response to tension in the tape T which exceeds a given value as will become apparent hereafter.

Figure 1:
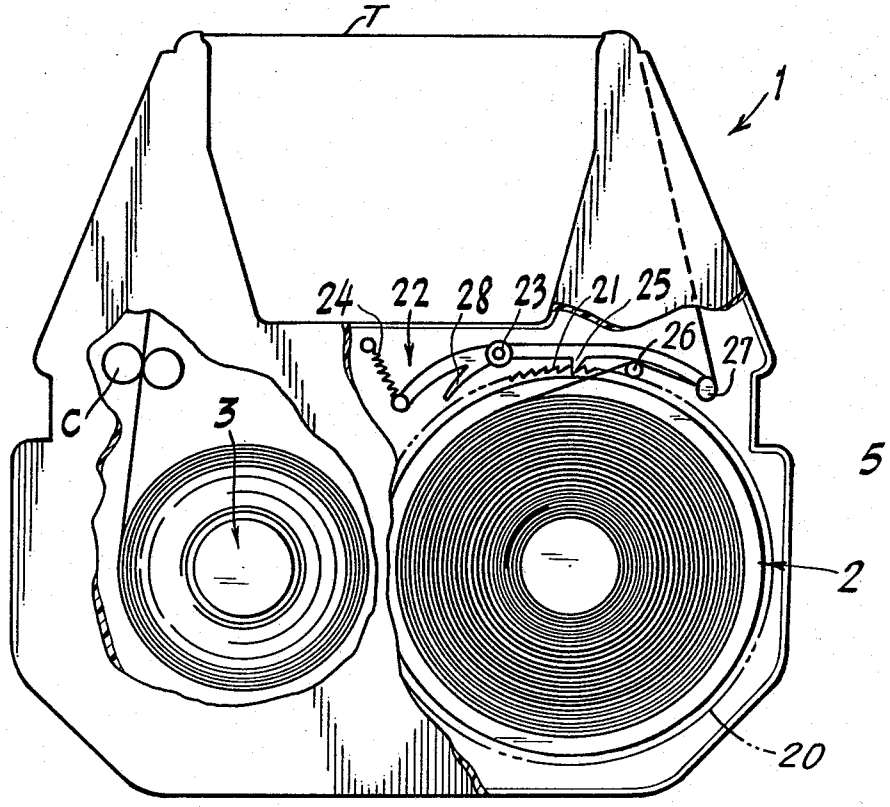
FIG. 1 is a top plan view, partly broken away, of a tape cartridge for a printer according to one embodiment of the invention.
Figure 5:
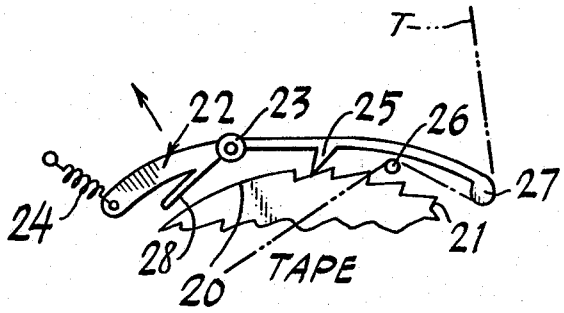
FIG. 5 is an enlarged view of a detail of the cartridge of FIG. 1.

Referring again to FIG. 1 and to the enlarged detail in FIG. 5, therein is seen a ratchet wheel 20 coaxially fixed to the supply reel 2 for rotation therewith. The periphery of the ratchet wheel 20 is formed with triangular ratchet teeth 21 equally spaced thereon. A ratchet lever 22 is supported adjacent to the ratchet wheel 21 by a pivot 23 around which the lever 22 can pivot in opposite directions. A spring 24 is attached to the lever 22 at one end to bias the lever 22 in clockwise direction. The lever 22 carries a pawl tooth 25 which faces the ratchet teeth 21 and is urged into engagement therewith under the force of the spring 24. The tape T passes from the supply reel 2 over a fixed guide roller 26 onto the free end 27 of the lever 22 in its passage to take-up reel 3. In normal operation, the supply reel 2 is prevented from rotating by the engagement of the pawl tooth 25 with a tooth 21 of the ratchet wheel 20. As tape T is pulled by the capstan C, tension in the tape T causes the ratchet lever 22 to rotate counterclockwise about pivot 23. This causes ratchet tooth 25 to disengage from the tooth 21 of the ratchet wheel 20, thus unlocking the ratchet wheel 20. Tension in the tape T now causes the ratchet wheel 20 to rotate clockwise which feeds out tape T from the supply reel 2 which is attached to the ratchet wheel 20. As the tape T is fed out, the lever 22 moves clockwise due to the tension in spring 24. This allows the ratchet tooth 25 to re-engage with a tooth 21 of ratchet wheel 20 thus locking the ratchet wheel 20 again. This process will be repeated until the end of the tape T is reached.

When the supply reel 2 is exhausted of tape T, in order to ensure that there is no motion of the supply reel 2, which would cause electrical pulses, the invention provides for a second pawl tooth 28 on lever 22 to engage ratchet teeth 21 to positively lock the supply reel 2 against rotation.

This is accomplished because as tape T is pulled by capstan C no tape T can be fed out from the supply reel 2 since it is empty and the end of tape T is secured to the supply reel 2 by means of an adhesive. Tension in the tape T increases causing the lever 22 to turn counter-clockwise a greater amount than under normal operation. The second ratchet pawl tooth 28 now engages a tooth 21 of the ratchet wheel 20 to positively lock the supply reel 2. In this way, locking of the supply reel 2 takes place at the end of tape T and the sensor 10 can detect halting of the supply reel 2 and halt the carrier and tape drives 13, 14 without any shaking of the carrier 4 causing any false signals.

While the invention has been described in relation to specific embodiments thereof, it will become apparent to those skilled in the art that numerous modifications and variations can be made within the scope and spirit of the invention as defined by the attached claims.

What is claimed is:

1. Apparatus for use with a tape cartridge for a printer to determine halt of tape feed from a supply reel having a tape thereon to a take-up reel, said apparatus comprising first means on one of said reels for undergoing rotation therewith, second means fixed in position to face said first means to cooperate with said first means without mechanical contact therewith for producing electrical output pulses as said first means rotates with said one reel, third means coupled to said second means for determining halting of rotation of said one reel and consequent halting of tape feed upon cessation of said output pulses, locking means for locking said supply reel against rotation at the end of tape feed from the supply reel, and ratchet means coupled to said supply reel, said locking means being coupled to said ratchet means, said ratchet means including a ratchet wheel secured for common rotation with said supply reel and a pivotable pawl lever engaging the tape under tension during feed of the tape and including a pawl tooth engageable with said ratchet wheel, said locking means including a second tooth on said lever for engaging said ratchet wheel to lock the ratchet wheel against rotation when tension in the tape increases at the end of tape feed.

2. Apparatus for use with a tape cartridge for a printer to determine halt of tape feed from a supply reel having a tape thereon to a take-up reel, said apparatus comprising means including alternate reflective and non-reflective portions coupled to one of said reels for undergoing displacement as said one reel rotates and the tape is being fed, a fixed irradiation means facing said reflective and non-reflective portions for irradiating said reflective and non-reflective portions alternately as said one reel rotates, a fixed receiver means for receiving pulses of reflected radiation from said reflective portion as said one reel rotates, means coupled to said receiver means for determining whether said one reel is rotating or has stopped depending on the presence or absence of said pulses, said reflective and non-reflective portions being arranged as alternating radial bands on said one reel, said one reel being the supply reel, locking means for locking said supply reel against rotation at the end of tape feed from the supply reel, ratchet means coupled to said supply reel, said locking means being engaged with said ratchet means, said ratchet means including a ratchet wheel secured for common rotation with said supply reel and a pivotable pawl lever engaging the tape under tension during feed of the tape and including a pawl tooth engagable with said ratchet wheel, said locking means including a second tooth on said lever for engaging said ratchet wheel to lock the ratchet wheel against rotation when tension in the tape increases at the end of tape feed.

3. A method of controlling a drive of a printer based on tape feed from a supply reel having a tape thereon to a take-up reel in a tape cartridge of the printer, said method comprising successively reflecting light from a light reflective portion on one of the reels during rotation thereof as the tape is being fed, receiving the successively reflected light and producing a train of electrical pulses in accordance therewith, halting the drive of the printer upon cessation of said electrical pulses, the tape cartridge being supported on a carrier which is driven during a printing operation, said carrier being halted upon cessation of said train of electrical pulses, and locking said supply reel against rotation upon increase in tension in the tape beyond a predetermined value.

4. A method as claimed in claim 3 wherein the supply reel is locked against rotation at the end of tape feed from the supply reel.

* * * * *